US010774839B2

(12) United States Patent
Alban et al.

(10) Patent No.: US 10,774,839 B2
(45) Date of Patent: Sep. 15, 2020

(54) DEVICE FOR GENERATING A DYNAMIC AXIAL THRUST TO BALANCE THE OVERALL AXIAL THRUST OF A RADIAL ROTATING MACHINE

(71) Applicant: Thermodyn SAS, Le Creusot (FR)

(72) Inventors: Thomas Alban, Le Creusot (FR); Sylvain Guillemin, Le Creusot (FR); Manuele Bigi, Florence (IT); Guiseppe Iurisci, Florence (IT); Stefano Falomi, Florence (IT)

(73) Assignee: THERMODYN SAS, Le Creusot (FR)

( * ) Notice: Subject to any disclaimer, the term of this patent is extended or adjusted under 35 U.S.C. 154(b) by 666 days.

(21) Appl. No.: 14/655,782

(22) PCT Filed: Dec. 18, 2013

(86) PCT No.: PCT/EP2013/077259
§ 371 (c)(1),
(2) Date: Jun. 26, 2015

(87) PCT Pub. No.: WO2014/102125
PCT Pub. Date: Jul. 3, 2014

(65) Prior Publication Data

US 2016/0195100 A1 Jul. 7, 2016

(30) Foreign Application Priority Data

Dec. 27, 2012 (EP) ..... 12306676

(51) Int. Cl.
*F04D 29/051* (2006.01)
*F04D 29/44* (2006.01)
(Continued)

(52) U.S. Cl.
CPC ..... *F04D 29/051* (2013.01); *F04D 17/12* (2013.01); *F04D 29/053* (2013.01);
(Continued)

(58) Field of Classification Search
CPC .... F04D 29/051; F04D 29/053; F04D 29/058; F04D 29/083; F04D 29/442; F04D 29/447; F04D 29/2266
See application file for complete search history.

(56) References Cited

U.S. PATENT DOCUMENTS 5,312,226 A * 5/1994 Miura ..... F16C 39/06 310/90.5
7,144,226 B2 * 12/2006 Pugnet ..... F04D 17/125 417/244

(Continued)

FOREIGN PATENT DOCUMENTS

CN 201751581 U 2/2011
CN 102292551 A 12/2011

(Continued)

OTHER PUBLICATIONS

European Search Report and Written Opinion issued in connection with corresponding EP Application No. 12306676.3 dated Jun. 20, 2013.

(Continued)

*Primary Examiner* — Carlos A Rivera
*Assistant Examiner* — Cameron A Corday
(74) *Attorney, Agent, or Firm* — Baker Hughes Patent Organization

(57) ABSTRACT

An impeller wheel assembly for a radial rotating machine, comprises a bladed hub portion of an impeller wheel, with a first radially outward facing, fluid deflecting surface having a curvature profile designed to deflect an axial fluid flow into a radial centrifugal flow, and comprising a deflector portion with a second radially outward facing, fluid deflecting surface. The second radially outward facing surface has a curvature profile designed to deflect a radial centripetal fluid flow into an axial fluid flow.

20 Claims, 2 Drawing Sheets

(51) Int. Cl.

| | |
|---|---|
| ***F04D 17/12*** | (2006.01) |
| ***F04D 29/053*** | (2006.01) |
| ***F04D 29/058*** | (2006.01) |
| ***F04D 29/08*** | (2006.01) |
| ***F04D 29/28*** | (2006.01) |
| ***F04D 29/42*** | (2006.01) |

(52) U.S. Cl.
CPC ..... *F04D 29/058* (2013.01); *F04D 29/083* (2013.01); *F04D 29/286* (2013.01); *F04D 29/4253* (2013.01); *F04D 29/441* (2013.01)

(56) References Cited

U.S. PATENT DOCUMENTS

| | | | | |
|---|---|---|---|---|
| 7,575,422 | B2 * | 8/2009 | Bode | F04D 25/0606 417/423.1 |
| 2011/0262284 | A1 | 10/2011 | Guernard | |
| 2011/0280710 | A1 | 11/2011 | Mariotti | |

FOREIGN PATENT DOCUMENTS

| | | | |
|---|---|---|---|
| DE | 1 004 332 | B | 3/1957 |
| DE | 1004332 | B | 3/1957 |
| FR | 2572469 | A1 | 5/1986 |
| FR | 2572469 | B1 | 4/1989 |
| JP | S55-100094 | U | 7/1980 |
| JP | H05-21198 | U | 3/1993 |
| JP | 3726005 | B2 | 12/2005 |
| JP | 2011-032908 | A | 2/2011 |
| JP | 2011-111990 | A | 6/2011 |
| JP | 2012-172756 | A | 9/2012 |
| SU | 875121 | A1 | 10/1981 |
| SU | 1399512 | A1 | 5/1988 |
| WO | 2013/011105 | A2 | 1/2013 |

OTHER PUBLICATIONS

International Search Report and Written Opinion issued in connection with corresponding Application No. PCT/EP2013/077259 dated Apr. 3, 2014.

Unofficial English translation of Office Action & Search Report issued in connection with corresponding CN Application No. 201380068660.7 dated Sep. 28, 2016.

Office Action and search report issued in connection with corresponding RU Application No. 2015125178 dated Aug. 11, 2017.

Notification of Reasons for Refusal issued in connection with corresponding JP Application No. 2015-550031 dated Nov. 7, 2017.

Office Action issued in connection with corresponding RU Application No. 2015125178 dated Dec. 14, 2017.

Office Action issued in connection with corresponding EP Application No. 123066763 dated Jul. 2, 2018.

Decision to Grant issued in connection with corresponding RU Application No. 2015125178 dated Jul. 20, 2018.

* cited by examiner

DEVICE FOR GENERATING A DYNAMIC AXIAL THRUST TO BALANCE THE OVERALL AXIAL THRUST OF A RADIAL ROTATING MACHINE

BACKGROUND

Embodiments of the present invention relate to radial rotating machines, such as centrifugal compressors or single stage fluid expanders.

In general, a radial rotating machine may be a rotating machine for processing a fluid flow, the fluid flow being forced to flow radially at least along part of the flow path.

A radial rotating machine is a rotating machine for processing a fluid flow, in which the fluid flow occurs radially at least along part of the flow path. The radial rotating machine may be for instance a centrifugal compressor.

Centrifugal compressors or single stage expanders are radial rotating machines: they comprise bladed impeller wheels, which are designed to force the fluid flow radially away from the axis of the rotating machine.

These impeller wheels are subjected to axial forces which may be of two types: so-called static axial forces, which are generated by the difference in fluid pressure between the upstream side and the downstream side of the wheel, and so-called dynamic axial forces, which are a result of the momentum change imposed to the fluids, flowing in axially into the impeller wheel, and coming out radially out of the wheel.

These axial forces are usually partly balanced by balance drum systems, and partly balanced by axial thrust bearings, for instance by oil bearings.

In said balance drum systems, at least a balance drum part is assembled around the same shaft as the impeller wheel. The balance drum part comprises two radially extending surfaces, facing opposite axial directions, and subjected to different fluid pressures.

These balance drum systems usually are tuned to counterbalance for static axial forces.

According to their design, balance drum systems can sometimes also counterbalance for part of the dynamic axial forces. The remainder of axial forces then has to be counterbalanced with axial thrust bearings. Axial thrust bearings may be of different types. Oil bearings are capable of withstanding high loads, but they have to be fed with the lubricating oils, which may be a hindrance in subsea applications, because of a lack of accessibility of the system, or in medical applications, where contamination by oil cannot be tolerated.

Depending on the maximum axial forces that the thrust bearing can withstand, and depending on the proportion of axial forces not counterbalanced by the balance drum, the fluid throughput of the machine has to be limited, to a value generally lower than the maximum throughput imposed by the other parameters of the radial rotating machine.

SUMMARY OF INVENTION

An embodiment of the invention propose an impeller wheel system which ensures a better axial force compensation, thus making it possible to use bearings of only the magnetic type. An embodiment of the invention reduces the overall length and mass of the system.

In an embodiment, there is provided an impeller wheel assembly for a radial rotating machine, comprises a bladed hub portion of an impeller wheel, with a first, radially outward facing fluid deflecting surface having a curvature profile designed to deflect an axial fluid flow into a radial centrifugal flow. The impeller wheel assembly comprises a deflector portion with a second radially outward facing fluid deflecting surface. The second radially outward facing surface has a curvature profile designed to deflect a radial centripetal fluid flow into an axial fluid flow, and is placed axially downstream, considering the direction of the axial fluid flows, of the first radially outward facing surface. The first, radially outward facing surface supports a plurality of blades of the bladed hub portion.

According to an embodiment of the invention, a radial rotating machine for processing a fluid, comprises one or more impeller wheels attached to a same shaft, each with a bladed hub portion, each bladed hub portion comprising a first radially outward facing, fluid deflecting surface having a curvature profile designed to deflect an axial fluid flow into a radial centrifugal flow. The machine also comprises:

- a shroud assembled around each hub portion so as to trap an axial fluid flow reaching the bladed hub portion and so as to force the fluid flow along the first outward facing surface,
- a stator including a guiding passage for a fluid coming from between the shrouds and the first outward facing surfaces, the passage comprising after each impeller wheel, a centrifugal diffuser portion followed by a bend, then followed by a centripetal return channel portion.

The machine comprises at least a deflector portion with a second radially outward facing, fluid deflecting surface, inserted into the fluid flow path, rotating together with the shaft, and having a curvature profile designed to deflect a radial centripetal fluid flow into an axial fluid flow. The machine comprises the same number of deflector portions inserted into the fluid flow path, as the total number of impeller wheel attached to the shaft.

A deflector portion may be placed upstream of a bladed hub portion.

A deflector portion may also be placed downstream of a bladed hub portion.

A deflector portion and a bladed hub portion may belong to a same impeller wheel part.

An impeller wheel assembly may comprise a rotor shaft, and may comprise a hub part defining a least part of the first outward facing surface, and a deflector part defining at least part of the second outward facing surface, both hub part and deflector part being assembled to the shaft so as to transmit both axial and rotational forces to the shaft.

The shaft may have a variable section so that the surface of the shaft defines a portion of either the first or the second outward facing surface.

The first outward facing surface and the second outward facing surface may each be defined by a globally concave surface, the concavity of each of the two surfaces facing opposite axial directions.

An impeller wheel assembly may comprise a first seal portion surface placed axially between the bladed hub portion and the deflector portion, the second outward facing surface extending from the most downstream side of the second outward facing surface, up to the first seal portion surface, by surface portions which are all oriented either radially, or facing radially outwards.

A second outward facing surface may comprise a central surface portion which comprises an axial surface portion, or a central surface portion which comes tangent to an axial direction.

A second outward facing surface may be limited by a radially outer surface portion which comprises an axial surface portion, or by a radially outer surface portion which comes tangent to a radial plane, the whole outward facing surface extending axially downstream of the radial plane.

When a deflector portion is placed upstream of a hub portion, a resulting impeller wheel assembly may be assembled in axial overhang to the shaft. The bladed hub portion is then next to the shaft and the deflector portion is on the axial side opposite to the shaft.

In an embodiment, at least a portion of a return channel is delimited by the second outward facing surface.

The radial rotating machine may comprise a first seal bridging a gap between the stator and the impeller wheel assembly, the first seal being at an axial position between the first outward facing surface and the second outward facing surface, and may comprise a second seal around the shroud, bridging a gap between the shroud an a stator part.

In some embodiments, the first seal is placed radially on the outside of the first outward facing surface, along a circumferential outer edge of the impeller wheel assembly.

In other embodiments, the first seal and the second seal extend roughly at a same radial distance from the axis of the shaft. One can consider the first seal and the second seal extend approximately at a same radial distance if the average radii of the two seals surfaces belonging to the impeller and to the shroud, differ of no more than 10%, and no more than 5% in an embodiment.

In the radial rotating machine, viewed in a radial plane, the angles between the centrifugal fluid flow leaving the first outward facing surface, and fluid flows along the second outward facing surface remain less than 180°. To achieve this, the first and second outward facing surfaces are so configured that, viewed in a radial plane, the angles between the outlet tangential direction of the first outward facing surface and the inlet tangential direction of the second outward facing surface remain less or equal to 180°. The inlet and outlet tangential directions are defined with respect to the fluid flow direction, that is, the directions are directions within the radial plane which are tangent to the surfaces, and the orientation of the directions used for the angle measurement is given by the fluid flow direction.

To define a radial centripetal flow or a radial centrifugal flow, one may consider that a fluid speed vector may form an angle with the axis of the impeller wheel which is comprised between 60° and 90°, and comprised between 80° and 90° in an embodiment. To define an axial fluid flow, one may consider that a fluid speed vector may form an angle with the axis of the impeller wheel comprised between 0° and 20°, and comprised between 0° and 20 in an embodiment.

In an embodiment, an impeller wheel assembly according to the invention comprises a first seal portion, running circumferentially around the impeller wheel assembly, placed axially between the first outward facing surface and the second outward facing surface. In an embodiment, the first seal portion is placed radially on the outside of the second outward facing surface (i.e. the first seal portion has a minimum radius larger than, or equal to, the maximum radius of the second outward facing surface). The seal portion is a surface portion with a surface profile and hardness adapted to face a seal element, for e.g. a metallic seal element assembled on a statoric element.

In an embodiment, the first seal portion is adjacent to at least the second radially outward facing surface. In a more specific embodiment, the first seal portion is adjacent both to the first and to the second radially outward facing surfaces.

In some embodiments, the impeller wheel assembly may comprise at least one radially extending surface extending between the first outward facing surface and the first seal portion, or may comprise at least one radially extending surface extending between the second outward facing surface and the first seal portion. In an embodiment, the second outward facing surface extends from its most downstream side, up to the first seal portion surface, by surface portions which are all oriented either radially, or facing radially outward. By radially extending surface one means either a radial surface or a surface extending both axially and radially. In an embodiment, the radially extending surface is a radial surface.

In an embodiment, the first outward facing surface and the second outward facing surface are each defined by a globally concave surface, the concavity of each of the two surfaces facing opposite axial directions. In an embodiment, each of the first and the second outward facing surface is a surface defined respectively by a first and a second radial section curve. The radial section curve is concave, with a constant curvature radius or with a continuously varying curvature radius. In an embodiment, the concavity of the first outward facing surface faces the upstream direction, and the concavity of the second outward facing surface faces the downstream direction. In another embodiment, the concavity of the first outward facing surface faces the downstream direction, and the concavity of the second outward facing surface faces the upstream direction.

In an embodiment, the second outward facing surface comprises a radially outer portion which comprises a radial surface portion, or comprises a radially outer surface portion which comes tangent to a geometrical radial plane. One may consider the surface comes tangent to a radial plane if the direction normal to the surface makes an angle with the axial direction which decreases as one moves along the surface toward its radially outer portion, and ends up making an angle of no more than 20°, and no more than 10° in an embodiment, from the axial direction on the outer circumference of the surface.

In an embodiment, the bladed hub portion and a deflector portion belong to a same single piece.

In an embodiment, the second outward facing surface comprises a central surface portion which comprises an axial surface portion, or a central surface portion which comes tangent to an axial direction. One may consider the central surface portion comes tangent to an axial direction if it comes tangent to a direction making an angle of no more than 20°, and no more than 10° in an embodiment, with the axial direction.

In some embodiments, the impeller wheel assembly may comprise a rotor shaft, may comprise a hub front part defining a least part of the first outward facing surface and may comprise a rear deflector part defining at least part of the second outward facing surface, both hub front part and rear deflector part being assembled to the shaft so as to transmit both axial and rotational forces to the shaft. In an embodiment, the hub front part and the rear deflector part are a single piece. In another embodiment, the hub front part and the rear deflector part are two different parts. The two different parts may be side by side, or may be separated by a third part, for e.g. by a third part comprising the first seal portion.

In an embodiment, the shaft has a variable section so that the surface of the shaft defines a portion of either the first or the second outward facing surface. Alternatively, or in addition to this, the assembly may comprise at least an additional ring assembled to the shaft, an outer surface of the ring defining a portion of either the first of the second outward facing surface not already defined by the hub front part, the rear deflector part or the shaft.

In an embodiment, the machine comprises fluid guiding blades within the diffuser channel, which blades extend at least partly axially and connect a first stator wall, defining one face of the return channel, to a diaphragm part, defining a portion of the other face of the diffuser channel. The diaphragm part also defines a face of the diffuser portion and an inside surface of the bend. In an embodiment, the second outward facing surface is placed so as to be aligned with one of the diaphragm walls, or so as to come tangent to one of the diaphragm walls.

The radial rotating machine may comprise a number n of stages with an impeller wheel, at least a number n−1 of impeller wheel assemblies with a first and a second outward facing surface, and may comprise an upstream deflector part, assembled to the shaft upstream of the first impeller wheel. The upstream deflector part may have a third type radially outward facing, fluid deflecting surface having a curvature profile designed to deflect a radial centripetal flow into an axial fluid flow directed towards the entrance of the first impeller wheel. The third type radially outward facing surface has a shape and a role similar to the second outward facing surface, but is born by a part which is not a downstream side of an impeller wheel. By first impeller wheel, we mean the most upstream impeller wheel. In an embodiment, all n impeller wheels have a first outward facing surface, and at least n−1 impeller wheels have a second outward facing surface that is all impeller wheels but the most downstream impeller wheel. The most downstream impeller wheel may, or may not, have a second outward facing surface, and the surface may or may not be included in the fluid flow path. In this embodiment, the dimensions and shape of the third deflecting surface, the dimensions and shapes of the n first outward facing surfaces and of the n−1 second outward facing surfaces are configured, so as to balance the overall dynamic axial forces exerted by the fluids on the n impeller wheels and on the upstream deflector part, for example so that the overall dynamic axial forces are less than 20% of the total dynamic axial forces exerted on the n first outward facing surfaces, and less than 10% of the total dynamic axial forces exerted on the n first outward facing surfaces in an embodiment. In one embodiment, the axial forces exerted by the fluids on the upstream deflector part mainly counterbalance the forces exerted on the first outward facing surface immediately downstream of the upstream deflector part. In another embodiment, the axial forces exerted by the fluids on the upstream deflector part, mainly counterbalance the forces exerted on the most downstream first outward facing surface. In yet another embodiment, the axial forces exerted by the fluids on the upstream deflector part, counterbalance the difference between the axial downstream dynamical efforts exerted by the fluids onto the n first outward facing surfaces, and the axial upstream dynamical efforts exerted by the fluids onto the n−1 second outward facing surfaces.

In an embodiment, the most upstream deflector part is placed upstream of a first bladed hub part, and does not form part of a return channel. The second radially outward facing surface of the deflector portion may then be a surface diverging toward a first axial end of the deflector portion distant from the hub portion, so as to reach or come tangent to a radial plane. In an embodiment, the second radially outward facing surface of the deflector portion may also be a surface converging so as to come tangent, toward a second axial end next to the hub portion, toward the first radially outward facing surface of the hub portion.

The deflector portion may comprise a radially inward facing surface continuously radially diverging in a direction away from the hub portion, along at least half of the axial length of the deflector portion. The inward facing surface defines a hollow region at the axial center of the deflector portion.

In this case, in an embodiment, the radial thickness of the deflector portion is maximum next to the hub portion. Thickness means here the material thickness of the part, excluding radial sizes of hollow regions. The maximum thickness of the deflector portion may be as least three times the minimum radial thickness of the deflector portion.

The rotor assembly may comprise a balance drum assembled to the shaft, which is a separate part from the impeller wheel assembly.

The rotor assembly may comprise a balance drum integrated to the bladed hub. The bladed hub portion may for instance comprise an annular sealing protrusion extending axially from the hub portion on the side of the wheel opposite to the deflector portion, the annular sealing protrusion facing a seal assembled to a stator portion.

The deflector portion may comprise a radially inward facing surface diverging radially in an axial direction away from the hub portion, and which is placed so as to be subjected to a same gas pressure as the gas pressure exerted on the first outward facing surface when the rotor assembly is in use.

In another embodiment, the deflector portion may face a seal system along a line which separates an area comprising the first outward facing surface from an area comprising a radially inward facing surface. The inner facing surface is then subjected to a different gas pressure from the gas pressure exerted onto the outer facing surface when the rotor is in use.

The deflector portion and the hub portion may each comprise respectively a first radial surface and a second radial surface, facing respectively a first half of a first axial thrust bearing and a second half of a second axial thrust bearing.

The deflector portion may comprise a portion of surface extending radially, and which is placed so as to be subjected to a gas pressure different from the gas pressure exerted on the first outward facing surface.

In an embodiment, the radial rotating machine comprises no other axial thrust bearings than the first axial thrust bearing and the second axial thrust bearing.

As a result of the self-balancing of dynamic axial forces within the machine, the shaft may be maintained axially within the stator by means of magnetical axial thrust bearings, without using additional types of axial bearings.

Some additional objects, advantages and other features of this invention shall be set forth in the description that follows.

BRIEF DESCRIPTION OF THE DRAWINGS

Non-exclusive embodiments will now be described, with reference to the attached drawings, wherein.

DETAILED DESCRIPTION

Figure 1:
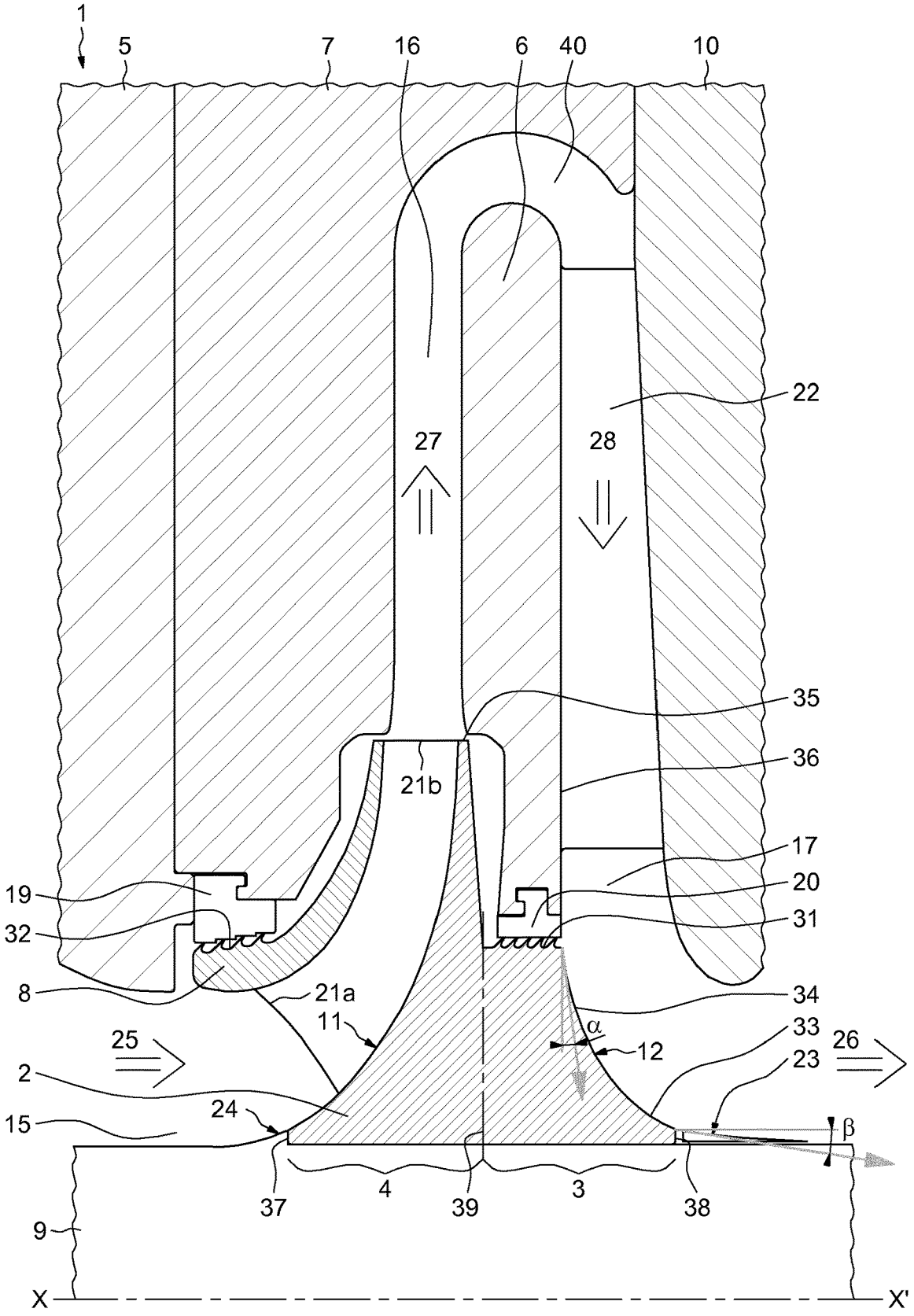
FIG. 1 is a simplified section view of a portion of a rotating machine according to an embodiment of the invention.

FIG. 1 shows a portion 1 of a centrifugal compressor according to an embodiment of the invention. The compressor comprises a shaft 9 rotating around an axis X-X'. An impeller wheel 2 is assembled around the shaft 9, so as to rotate around the axis X-X' together with the shaft 9, and so as to transmit to the shaft axial forces imparted by fluids to the impeller 2. In the description "fluid" or "fluids" refers to the fluids processed by the radial rotating machine.

In the description, by "radial surface" one means a surface generated by a series of radial lines, i.e. a surface perpendicular to the axis X-X' of the rotating machine 1.

By "axial surface", one means a surface generated by a series of axial lines, i.e. a portion of cylindrical surface with an axis parallel to the axis X-X'.

The impeller wheel 2 comprises a bladed hub portion 4 and a deflector portion 3, placed downstream of the bladed hub portion 4.

By downstream one means downstream along the fluid flow path of the fluids circulating within the rotating machine 1. Both bladed hub portion 4 and deflector portion 3 are in contact with the fluid flow and they contribute to guiding the fluid flow.

The bladed hub portion comprises a first radially outward facing surface 11 onto which several impeller blades (not visible on the figures) are assembled, distributed between an inner line 21*a* and an outer line 21*b*.

The bladed hub portion is covered, on its radially external side, by a shroud 8. This way, a fluid channel is defined between the blade hub portion and the shroud. The fluid channel is so designed as to deflect an incoming axial fluid flow 25 into an outgoing radial centrifugal flow 27.

The deflector portion 3 is placed downstream from the bladed hub portion 4, and comprises a second radially outward facing surface 12. Both the first outward facing surface 11 and the second outward facing surface 12 extend at least partially in a radial direction and at least partially in an axial direction. The first outward facing surface 11 and the second outward facing surface 12 face opposite axial directions. On the embodiment illustrated on FIG. 1, the impeller wheel comprises a first radial surface 37 at an axial end of first outward facing surface 11, and a second radial surface 38 at an axial end of second outward facing surface 12.

The impeller wheel extends axially between the first radial surface 37 and the second radial surface 38. In some embodiments, surface 37 and/or surface 38 can be reduced each to a circle line.

The bladed hub portion 4 and the deflection portion 3 can be defines by two separate parts. They can, in an embodiment, be defined by a same single part. In this case, an arbitrary axial limit between the two portions can be defined by any radial plane 39, the radial plane 39 running between the first outward facing surface 11 and the second outward facing surface 12 without intercepting any of the two surfaces. Such a radial geometrical plane 39 may be defined also in cases when the first outward facing surface and the second outward facing surface belong to two different parts.

Figure 2:
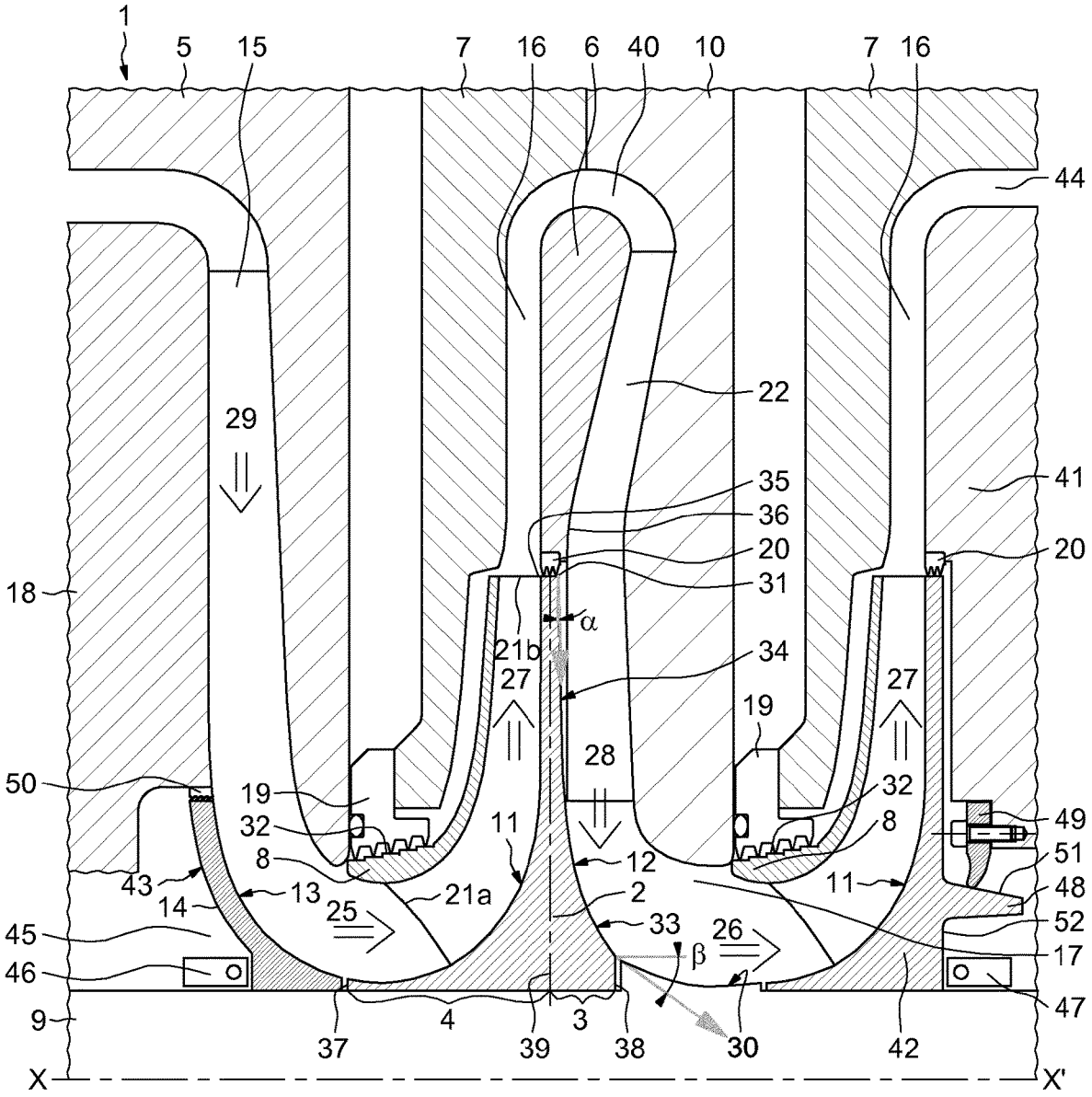
FIG. 2 is a simplified section view of a portion of another embodiment of a rotating machine according to the invention.

In some embodiments, the first and the second outward facing surface can be globally obtained by rotating around the axis X-X', some section lines of the impeller wheel, such as the lines defining the contour of impeller wheel 2 on FIG. 1 or on FIG. 2.

In other embodiments, the first and the second outward facing surface may not be exactly surfaces of revolution. They may for instance be obtained by a periodical rotation around axis XX', of a set of initial generating surface portions.

The impeller wheel 2, the shaft 9 and the shroud 8 are surrounded by stator parts such as an inlet cover 5, a diffuser wall 7, a diaphragm 6 and a return channel wall 10. The inlet cover 5 contributes to guiding the incoming axial fluid flow 25. The incoming axial fluid flow 25 reaches an impeller eye defined by a radial aperture between the shroud 8 and the impeller 2. In some embodiments, such as on FIG. 2, the inlet cover 5, may, together with a statoric upstream inlet wall 18, define at least partly an inlet channel 15 guiding a centripetal flow 29 towards the impeller eye, and deflecting the fluid flow into an axial flow before it enters the impeller eye.

Coming back to FIG. 1, the radial centrifugal flow 27 leaves the impeller 2, then is guided by a diffuser channel 16 defined between the diffuser wall 7 and a diaphragm part 6. It then reaches a channel bend 40. The channel bend 40 is defined between a portion of the diffuser wall 7, a portion of a return channel wall 10, and the diaphragm part 6. It could also be defined only between a return channel wall, and a diaphragm part. After the bend 40, the fluids are guided through a return channel 17, following a centripetal flow direction, towards a second deflecting surface 12 located at the back (i.e. on the downstream side) of the impeller wheel 2. An upstream portion of return channel 17 is defined in an axial space between diaphragm part 6 and return channel wall 10. The diaphragm part 6 may be held by return channel blades 22 bridging the axial gap between the diaphragm part 6 and the return channel wall part 10. A downstream portion of return channel 17 is defined between the return channel wall part 10 and the second outward facing surface 12. This downstream portion of the return channel is curved so as to deflect a centripetal fluid flow 28 into an axial fluid flow 26. The axial fluid flow 26 may then enter a second impeller eye of a second impeller 42 placed downstream of the first impeller 2, as described on FIG. 2. Impeller 2 and impeller 42 belong to a same multistage machine, for instance a two stage machine as in the embodiment depicted on FIG. 2. The multistage machine may comprise more than two stages, in which case all impeller wheels of the machine, except the most downstream impellers, may comprise both a first outward facing surface and a second outward facing surface in the return channel associated with the wheel, as described previously. In some embodiments, the most downstream impeller wheel may comprise no downstream deflecting surface, i.e. no second outward facing surface. In other embodiments, the most downstream impeller wheel may have the same shape as the upstream impellers, the second outward facing surface being simply not inserted into the fluid flow path of the rotating machine.

Coming back to FIG. 1, an impeller eye seal 19 is assembled to the diffuser wall 7. The seal 19 contacts the shroud 8 so as to avoid leakage of the incoming fluid flow 25, and avoid it leaking directly towards the diffuser channel 16 without traversing the fluid channel defined between the shroud 8 and the bladed hub portion 4.

The second outward facing surface 12 comprises a deflecting surface of sufficient radial and axial extent, and of adequate curvature, in order to transform the radial centripetal flow 28 within the deflector portion 3 into an axial flow 26 leaving the return channel 17.

In this way, the total dynamic axial forces exerted by the fluids onto the second outward facing surface 12 are opposite in direction and in amplitude to the total dynamic axial forces exerted by the fluids onto the first outward facing surface 11.

The rotating machine may be a single stage machine, or a multistage machine.

To deflect an axial fluid flow into a radial fluid flow, the first outward facing surface 11 may be completed by a deflector surface portion 24 belonging to the shaft 9, as on FIG. 1, or the first outward facing surface 11 may be completed by a deflector surface portion belonging to a ring assembled to the shaft (not illustrated on the figures), or the first outward facing surface 11 may be completed by a deflector surface portion belonging to another deflector part 14 assembled upstream of the wheel 2, as illustrated on FIG. 2. In this case, the first outward facing surface 11 may be adjacent to a radial surface 37 defining axially the upstream limit of impeller wheel 2.

The second outward facing surface 12 extends radially far enough from the axis X-X' of the rotating machine. In an embodiment, the second outward facing surface 12 extends radially further than the internal radius of the shroud 8—internal radius being counted as a minimum distance between the axis X-X' and an inner face of the shroud 8—. In an embodiment, the difference between the maximum diameter of at least a second outward facing surface 12 and the minimal diameter of the first outward facing surface 11 following it, is more than 150% of the radial distance between the inner diameter of the shroud covering the first outward facing surface and the minimal diameter of the first outward facing surface 11.

In this way, sufficient axial deflection forces are provided by the fluids in return channel 17, and the downstream side of the impeller wheel 2 is subjected to sufficient axial deflecting forces, in order to balance the deflecting forces exerted on the upstream side of the impeller wheel.

In an embodiment, the second outward facing surface 12 comprises a radially outer surface portion 34 which comprises a radial surface portion, or comprises a radially outer surface portion which comes tangent to a geometrical radial plane.

In some embodiments, the second outward facing surface 12 may not come exactly tangent to a radial plane, but it comprises a circumferential, radially outer surface portion 34, that makes a limit angle $\alpha$ of no more than 10°, and no more than 5° in an embodiment, from a radial plane. The limit angle $\alpha$ may for instance be measured as the angle between the axial direction and a direction normal to the second outward facing surface 12. On both FIGS. 1 and 2, the amplitude of limit angle $\alpha$ is exaggerated, as the corresponding surface angle is very close to zero.

As can be read from FIG. 2, one could imagine a deflection of the fluid flow between the radial centrifugal direction of the fluid flow 27 leaving the upstream side of impeller wheel 2, and the centripetal fluid flow in the upstream part of return channel 17, which could reach a deflection angle of more than 180° with. Still, in an embodiment, this deflection angle is no more than 180°, in order to improve the balancing effect of dynamic axial forces. To the same purpose, the whole second outward facing surface is curved axially forwards, that is to say, when one moves radially along this surface towards axis XX', the axial coordinate of a contact point with the surface can only increase (in the downstream direction) or stay constant for a while, never decrease.

As a consequence, all portions of surface 12 are radially outward facing. By avoiding surface portions facing radially inwards, one gets a better balancing effect of fluid forces exerted on impeller wheel 2.

To deflect a radial fluid flow into an axial fluid flow, the second outward facing surface 12 may be completed by a deflector surface portion 30 belonging to the shaft 9, as illustrated on FIG. 2, or belonging to a ring 23 assembled to the shaft, as illustrated on FIG. 1, or belonging to a downstream impeller wheel (not illustrated). In this case, the second outward facing surface 12 may be adjacent to a radial surface 38 defining axially the downstream limit of impeller wheel 2.

In an embodiment, the second outward facing surface 12 comprises a central surface portion 33 which comprises an axial surface portion, or comprises a central surface portion 33 which comes tangent to an axial cylinder surface.

In some embodiments, the second outward facing surface 12 may not come exactly tangent to an axial cylinder surface, but the second outward facing surface 12 should comprise a central surface portion 33 that makes an angle $\beta$ of no more than 10°, and no more than 5° in an embodiment, from an axial direction, for the same reasons aiming at achieving an efficient axial balance of dynamic forces exerted by the fluid. The angle $\beta$ may be measured between a tangent line to the surface comprised in a radial plane, and the axial direction of axis XX'.

As can be seen on FIG. 1, the rotating machine 1 may comprise a downstream pressure seal 20, which can be for instance a labyrinth seal, and which is placed between the diaphragm part 6 and a first seal portion 31 of the impeller wheel 2. The seal portion 31 may be a stepped, or an unstepped, surface in an embodiment, running circumferentially around the wheel 2.

In the embodiment illustrated on FIG. 1, the first seal portion is placed radially closer to the axis XX' than the outer edge of the impeller wheel. The first seal portion 31 is separated from the outer edge by a more or less radial surface portion, and is separated from the shaft 9 by the second outward facing surface 12.

The rotating machine 1 may comprise a second seal surface portion 32 running around the shroud 8 and facing the seal 19 of the impeller eye. This second seal surface portion 32 is a stepped surface in an embodiment. The distance of this surface from axis XX' may for instance be measured as the average value between the axial surface portion which is in contact with seal 19, and is closest to axis XX', and the axial surface portion which is in contact with seal 19, and is placed at the largest distance from axis XX'.

In the embodiment depicted on FIG. 1, the radial distance from axis XX', of the first seal portion 31, is almost the same—that is here, differing of no more than 20%, and of no more than 10% in an embodiment—as the average distance separating the second seal surface portion 32. An advantage of this embodiment is that the static pressure differences are better balanced than in the embodiment depicted on FIG. 2.

In the embodiment, illustrated on FIG. 2, the first seal portion runs along a radially outer edge 35 of impeller wheel 2, which reduces the overall length of the machine.

First and second seal portions 31 and 32 may be flat axial surfaces, stepped axial surfaces, or teethed surfaces facing a flat or a stepped surface on seals 19 or 20.

The second outward facing surface 12 is placed so as to come flush—according to embodiments, sometimes with seal 20 in between—with the diaphragm wall 36 defining the return channel.

The second outward facing surface 12 together with the diaphragm wall 36, form an almost continuous surface designed to guide the fluid first in a centripetal direction 28, then to deviate it to an axial direction 26. The second outward facing surface 12 together with the diaphragm wall 36, sometimes with a portion of more or less radial surface belonging to seal 20, form a deflecting surface, the radial section line of which has a continuously varying radius of curvature. Wall 36 may be mainly radial, or may be slightly frustoconical getting wider towards the shaft 9.

As was already hinted above, FIG. 2 illustrates another embodiment of a radial rotating machine according to the invention.

Similar elements to FIG. 1 can be found on FIG. 2, which are designated by same references.

On the embodiment of FIG. 2, the radial rotating machine is a multistage machine, in the illustrated case a two stage machine. It comprises a first impeller wheel 2 with a first outward facing surface and a second outward facing surface as described previously. It also comprises a downstream impeller wheel 42 with only a first outward facing surface 11. The dynamic axial forces exerted on first outward facing surface 11 of wheel 2 are compensated by dynamic axial forces exerted on second outward facing surface 12 of wheel 2. The second, and last, impeller wheel 42 is not followed by a return channel, as the diffuser 16 is followed by an outlet channel 44 defined between diffuser wall 7 and a final diffuser wall 41. The dynamic axial forces exerted on first outward facing surface 11 of wheel 42 are compensated by dynamic axial forces exerted on a third outward looking surface 13 belonging to an upstream deflector part 14, placed upstream of the first impeller wheel 2. The third outward looking surface 13 has a shape similar to the shape of the second outward facing surface, and is placed flush with a radial wall surface portion belonging to an upstream inlet wall part 18. A seal, for instance a labyrinth seal, may be present between the inlet wall part 18 and a radially outer edge of deflector part 14. In other embodiments, a gap may be present between the inlet wall part 18 and a radially outer edge of deflector part 14.

In an embodiment, deflector part 14 comprises a radially inward facing surface 43 defining a free space 45 between the upstream deflector part 14 and the shaft, opened around the shaft at the upstream end of the deflector part. In this way the total weight of the rotor is reduced. In the embodiment illustrated on FIG. 2, the radial rotating machine comprises an upstream balance drum seal 50 placed so as to avoid gas leakage between the inlet channel 15 and the hollow space 45. The radial rotating machine of FIG. 2 comprises a downstream balance drum seal 49, assembled to the final diffuser wall 41 so as to come into contact with an axially extending surface 51 belonging to an axial protrusion 48 of the most downstream bladed hub portion 42.

The protrusion 48 is a more or less an annular axially extending protrusion, extending axially to the downstream side of the bladed hub portion 42, so as to define an axially extending surface 51 radially close to the diffuser wall 7.

Seal 49 makes it possible to get a different gas pressure within the gas channel along the most downstream impeller 42, from the pressure on an at least partly radial surface of the impeller part, surrounded by protrusion 48. This pressure difference generates axial forces which can be tuned to compensate for at least part of the static axial load exerted on the impellers and deflectors assembled to the shaft 9. A similar tuning effect is also achieved with seal 50.

In the illustrated embodiment, the deflector part 14 comprises a radial surface portion within the hollow region 45, facing a half axial thrust bearing 46, for example a magnetical half bearing. In other embodiments, deflector part 14 may also comprise a radial surface portion without defining hollow region 45, and the radial surface portion may face a half axial thrust bearing. When the half bearing is placed in a hollow region 45, the overall length of the machine is reduced. A second half axial bearing 47, such as a magnetical half bearing, may face a downstream radial surface belonging to a downstream impeller wheel. As a result of the self balancing of dynamical axial forces due to the outward facing surfaces, the machine may comprise only 2 half magnetical bearings 46 and 47, without a need for additional thrust bearings.

A rotating machine according to an embodiment of the invention, with some features either of FIG. 1 or of FIG. 2, could have more than 2 stages, for example a number n of stages, n being greater than, or equal to two. It could comprise, from the upstream side to the downstream side along axis XX', an upstream deflector part 14, a number n−1 of impeller wheels 2 with a first and a second outward facing surface, and a downstream wheel either without a second outward facing surface S, or with a second outward facing surface not pertaining to a return channel.

A rotating machine according to an embodiment of the invention, especially a single stage machine, could be devoid of a second outward looking surface downstream of any impeller wheel, and comprise only a first outward looking surface 11 on an impeller wheel, associated with an upstream "third" outward looking surface 13, configured to balance the axial forces exerted by the fluid on the first outward looking surface 11.

The invention is not limited to the embodiments described and illustrated above, which are to be regarded as mere examples of a wider range of embodiments.

The first and second, the first and third outward looking surface may or may not belong to a same part. The balancing effect may not be calculated to be achieved on two adjacent surfaces, but may be calculated to be achieved between all axially upstream and all axially downstream deflecting rotating surfaces.

When the first and second outward looking surface belong to a same part that is the impeller wheel 2, one can say that a portion of the return channel 17 is delimited by the impeller wheel 2. In some embodiments, such as on FIG. 2, the statoric return channel blades 22 extend at least partially in a portion of the return channel delimited by the second outward facing surface 12.

In an embodiment, the rotating machine handles gases but may handle other types of fluids, such as gaseous liquid droplets suspensions.

A portion of the second outward facing surface 12 may belong to a same part defining also the upstream side of impeller wheel 2, and another portion of the second outward facing surface 12, or several other portions, may belong to either the shaft itself, or may be defined by separate parts assembled to the shaft.

With an impeller wheel assembly according to an embodiment of the invention, the remainder of axial forces which is to be counterbalanced by axial thrust bearings is reduced. The size of the axial thrust bearing may then be reduced, or oil bearings can be replaced by magnetical thrust bearings. In the embodiment of FIG. 2, the total length of the radial rotating machine may be shorter than in prior art machines, due to the fact that the axial distance between the impeller wheel channel and the return channel is reduced to a minimum.

In the embodiment of FIG. 1, the total axial length of the machine is higher, but static pressure forces are self-balanced in addition to the self-balancing of dynamical pressure forces.

Owing to the axial forces self balancing ability of the impeller wheel assembly, higher fluid throughputs can be allowed through the rotating machine. Such high throughputs sometimes occur in transient regimes, which formally implied designing much bulkier thrust bearings.

The impeller wheel assembly according to an embodiment of the invention does enable to construct more compact radial rotating machines with wider functioning ranges, especially as fluid throughput is concerned.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

What is claimed is:

1. A radial rotating machine for processing a fluid, the radial rotating machine comprising:

one or more impeller wheels attached to a same shaft, each with a bladed hub portion, each bladed hub portion comprising a first radially outward facing surface having a curvature profile designed to deflect an axial fluid flow into a radial centrifugal flow;

a shroud assembled around each hub portion to trap an axial fluid flow reaching the bladed hub portion and to force the axial fluid flow along the first radially outward facing surface;

a stator comprising a guiding passage for a fluid coming from between the shroud and the first radially outward facing surface, the guiding passage comprising, after each impeller wheel, a centrifugal diffuser portion followed by a bend, then followed by a centripetal return channel portion; and at least one deflector portion with a second radially outward facing surface inserted into a fluid flow path, rotating together with the shaft, and having a curvature profile designed to deflect a radial centripetal fluid flow into an axial fluid flow, wherein the second radially outward facing surface has an upstream surface portion extending tangentially to a radial plane, the radial plane extending perpendicular to an axis of the shaft;

wherein the number of the at least one deflector portion is the same as the total number of the one or more impeller wheels attached to the shaft.

2. The radial rotating machine according to claim 1, wherein a respective one of the at least one deflector portion is placed upstream of each bladed hub portion.

3. The radial rotating machine according to claim 2, wherein at least one of the deflector portions belongs to a same impeller wheel part, as the bladed hub portion that the at least one of the deflector portions follows in the downstream direction.

4. The radial rotating machine according to claim 3, wherein each bladed hub portion, but a most downstream one, and a respective one of the at least one deflector portions located downstream of the respective bladed hub portion forms a respective same part of the at least one of the impeller wheels.

5. The radial rotating machine according to claim 3, wherein the impeller wheel part comprises a first seal portion surface placed axially between its bladed hub portion and its deflector portion, the second outward facing surface being defined, on its extension from a most downstream side of the second outward facing surface, up to the seal portion surface, by surface portions which are all oriented either radially, or facing radially outwards.

6. The radial rotating machine according to claim 3, wherein the second radially outward facing surface comprises a downstream central surface portion comprising a downstream surface portion extending tangentially to an axial plane, the axial plane extending parallel to the axis of the shaft.

7. The radial rotating machine according to claim 3, wherein the second radially outward facing surface extends axially downstream of the radial plane.

8. The radial rotating machine according to claim 1, wherein one of the bladed hub portions and one of the at least one deflector portions located downstream of the one of the bladed hub portions forms a same part of at least one of the impeller wheels.

9. The radial rotating machine according to claim 8, wherein each bladed hub portion, but the most downstream one, and a respective one of the at least one deflector portions located downstream of the respective bladed hub portion forms a respective same part of the at least one of the impeller wheels.

10. The radial rotating machine according to claim 8, wherein the same part of the at least one impeller wheel comprises a seal portion surface placed axially between its bladed hub portion and its deflector portion, the second radially outward facing surface being defined, on its extension from a most downstream side of the second radially outward facing surface, up to the seal portion surface, by surface portions which are all oriented either radially, or facing radially outwards.

11. The radial rotating machine according to claim 8, further comprising:

a first seal bridging a gap between the stator and the impeller wheel part, the first seal being at an axial position between the first radially outward facing surface and the second radially outward facing surface of the impeller wheel part; and a second seal around the shroud, bridging a gap between the shroud and a stator part.

12. The radial rotating machine according to claim 11, wherein the first seal and the second seal extend approximately at a same radial distance from the axis of the shaft.

13. The radial rotating machine according to claim 1, wherein the shaft comprises a variable section so that a surface of the shaft continues a portion of at least one of the first radially outward facing surface and the second radially outward facing surface.

14. The radial rotating machine according to claim 1, wherein, viewed in a radial plane, the angles between the outlet tangential direction of the first radially outward facing surface and the inlet tangential direction of the second radially outward facing surface remain less or equal to 180°, and wherein the inlet and outlet tangential directions are defined with respect to the fluid flow direction.

15. The radial rotating machine according to claim 1, further comprising magnetic axial thrust bearings as sole bearings to balance the axial forces exerted on the shaft.

16. The radial rotating machine according to claim 1, wherein an angle between the upstream surface portion of the deflector portion, and the radial plane is no more than 10°.

17. The radial rotating machine according to claim 1, wherein an angle between the upstream surface portion of the deflector portion, and the radial plane is no more than 5°.

18. The radial rotating machine according to claim 1, wherein the second radially outward facing surface having a downstream surface portion extending tangentially to an axial plane, the axial plane extending parallel to the axis of the shaft.

19. The radial rotating machine according to claim 18, wherein an angle between the downstream surface portion of the deflector portion, and the axial plane is no more than 10°.

20. The radial rotating machine according to claim 18, wherein an angle between the downstream surface portion of the deflector portion, and the axial plane is no more than 5°.

* * * * *